US009382869B2

(12) United States Patent
Freidhager

(10) Patent No.: US 9,382,869 B2
(45) Date of Patent: Jul. 5, 2016

(54) PISTON FOR AN INTERNAL COMBUSTION ENGINE

(75) Inventor: Marcus Freidhager, Erlangen (DE)

(73) Assignee: Federal-Mogul Nurnberg GmbH, Nuremberg (DE)

( * ) Notice: Subject to any disclaimer, the term of this patent is extended or adjusted under 35 U.S.C. 154(b) by 259 days.

(21) Appl. No.: 13/000,219

(22) PCT Filed: Jun. 15, 2009

(86) PCT No.: PCT/EP2009/057349

§ 371 (c)(1),
(2), (4) Date: Mar. 28, 2011

(87) PCT Pub. No.: WO2009/153237

PCT Pub. Date: Dec. 23, 2009

(65) Prior Publication Data

US 2011/0180025 A1 Jul. 28, 2011

(30) Foreign Application Priority Data

Jun. 20, 2008 (DE) ..... 10 2008 002 571

(51) Int. Cl.

| | |
|---|---|
| ***F01P 1/04*** | (2006.01) |
| ***F02F 3/22*** | (2006.01) |
| ***F02F 3/16*** | (2006.01) |
| ***B22C 9/10*** | (2006.01) |

(52) U.S. Cl.
CPC . *F02F 3/22* (2013.01); *B22C 9/105* (2013.01); *F02F 3/16* (2013.01)

(58) Field of Classification Search
USPC ..... 123/41.35
See application file for complete search history.

(56) References Cited

U.S. PATENT DOCUMENTS

| | | | | |
|---|---|---|---|---|
| 3,190,273 | A * | 6/1965 | Bachle et al. | 123/41.35 |
| 4,530,312 | A * | 7/1985 | Kanda et al. | 123/41.35 |
| 5,890,416 | A * | 4/1999 | Thieme et al. | 92/186 |
| 5,947,065 | A * | 9/1999 | Bing et al. | 123/41.35 |
| 5,979,298 | A * | 11/1999 | Whitacre | 92/211 |
| 6,499,386 | B2 * | 12/2002 | Martin et al. | 92/186 |
| 7,131,418 | B2 * | 11/2006 | Wieland | 123/193.6 |
| 7,308,850 | B2 * | 12/2007 | Scharp | 92/186 |
| 7,484,295 | B2 * | 2/2009 | Appo | 29/888.045 |
| 8,001,946 | B2 * | 8/2011 | Leitl | B22C 9/105 123/193.6 |
| 8,079,403 | B2 * | 12/2011 | Kollotzek | 164/369 |
| 8,122,935 | B2 * | 2/2012 | Kollotzek | 164/369 |
| 2002/0162448 | A1 | 11/2002 | Martin | |
| 2005/0211088 | A1 | 9/2005 | Wieland | |
| 2007/0107215 | A1 * | 5/2007 | Scharp | 29/888.042 |
| 2008/0121205 | A1 * | 5/2008 | Scharp | 123/193.6 |
| 2008/0289490 | A1 * | 11/2008 | Linz et al. | 92/186 |
| 2009/0007776 | A1 * | 1/2009 | Benz et al. | 92/160 |

(Continued)

FOREIGN PATENT DOCUMENTS

| | | | | |
|---|---|---|---|---|
| DE | 822922 | * 11/1951 | | F02F 3/16 |
| DE | 2351166 | A * 10/1972 | | F02F 3/22 |

(Continued)

*Primary Examiner* — Marguerite McMahon
*Assistant Examiner* — Tea Holbrook
(74) *Attorney, Agent, or Firm* — Robert L. Stearns; Dickinson Wright, PLLC

(57) ABSTRACT

A piston for an internal combustion engine comprises at least one cooling channel located only in the areas of at least one inflow and at least one outflow at a low level comparatively removed from the base of the piston and at a constant higher level closer to the piston base, said cooling channel comprising steep inclines between the areas located at the low and at the high level.

15 Claims, 1 Drawing Sheet

(56) References Cited

U.S. PATENT DOCUMENTS

| | | | | |
|---|---|---|---|---|
| 2009/0025550 | A1 | 1/2009 | Benz et al. | |
| 2010/0163203 | A1 * | 7/2010 | Kollotzek | 164/369 |

FOREIGN PATENT DOCUMENTS

| | | | | | |
|---|---|---|---|---|---|
| DE | 23 51 166 | A1 | | 4/1974 | |
| DE | 10126493 | A1 | * | 12/2002 | F02F 3/20 |
| DE | 102007044105 | A1 | * | 10/2008 | |
| DE | 102008031864 | A1 | * | 1/2010 | F02F 3/22 |
| JP | 2002 221086 | A | | 8/2002 | |
| JP | 2002221086 | A | * | 8/2002 | F02F 3/22 |
| JP | 2003526755 | A | | 9/2003 | |
| JP | 2006090159 | A | * | 2/2004 | F02F 3/22 |
| JP | 2006090158 | A | | 4/2006 | |
| JP | 2006090159 | A | * | 4/2006 | |

* cited by examiner

PISTON FOR AN INTERNAL COMBUSTION ENGINE

FIELD OF THE INVENTION

The invention relates to a piston for an internal combustion engine.

In the field of internal combustion engines, provision must generally be made for sufficient cooling of the piston. Furthermore, the specific power outputs of engines, in particular diesel engines, are continuously increasing, which leads to increasingly high piston temperatures. This can affect both lifespan and strength. Inasmuch, provision must be made for efficient cooling, in particular at critical locations such as, for example, the combustion bowl rim and the uppermost ring groove of the piston.

PRIOR ART

Apparent from JP 2002 221086 is a piston in which the cooling channel in the region of the piston pin bosses is lowered in the direction of the same.

WO 03/098022 relates to a piston in which the cooling channel expands continuously in the direction of a lower level from the inlet to the outlet.

DESCRIPTION OF THE INVENTION

The object forming the basis for the invention is to create a piston for an internal combustion engine, which is improved in terms of cooling, in particular of the critical areas.

According thereto, this piston comprises at least one cooling channel which, solely in the area of at least one inflow and at least one outflow, is disposed at a comparatively low level that is comparatively further away from the piston head, and which is otherwise disposed at a consistently higher level that is comparatively closer to the piston head. Owing to the arrangement at the comparatively "high" level, the cooling channel can be configured over the majority of its progression particularly close to the critical locations such as, for example, the bowl rim and the uppermost ring groove. In particular, the cooling channel can be disposed almost completely at the level of a ring carrier so that this critical area can be cooled particularly efficiently. This applies in a similar manner to the region of the combustion bowl which abuts in the direction of the axis of rotation of the piston. Also in this regard the cooling channel in the piston according to the invention can be formed almost completely at the level of the combustion bowl such that a particularly good cooling effect is achieved here.

At the same time, the requirements at the inflow and outflow can be taken into account particularly well in the piston according to the invention. In these areas it is namely advantageous for the cross-section of the cooling channel to be slightly enlarged as compared to the rest of its progression so as to ensure a favourable inflow and outflow. An inflow and outflow that is enlarged in this manner can be formed particularly easily in the piston according to the invention in that in the region of at least one inflow and at least one outflow, the cooling channel is disposed at a lower level, i.e. at a level that is further away from the piston head. In these zones, the cooling channel is therefore lowered slightly from the region between the uppermost ring groove and the combustion bowl so that the cross-section enlargement of the cooling channel can be provided without compromising strength. A sufficient material thickness with respect to both the uppermost ring groove and the combustion bowl can namely be maintained so as to continue to meet strength requirements.

Owing to the fact that the cooling channel is disposed at the lower level only in the area of the inflow and at least one outflow and otherwise remains at substantially the same, higher level, a particularly efficient cooling of the critical areas at the uppermost ring groove and the combustion bowl can be ensured over substantially the entire circumference. It is noted that the cooling channel may comprise further inflows and outflows. In particular, one or more outflows, preferably with a comparatively small cross-section, may be provided over its progression so as to lubricate the bearing between the piston rod and the piston pin. However, the cooling channel does not necessarily have to be at the lower level in the region of these outflows since no enlargement is necessary here.

As regards the arrangement of the cooling channel at the higher level, it has proven to be favourable in first attempts for the lower edge of the cooling channel at this level to be substantially at the same height as the lower edge of a ring carrier for the uppermost ring groove. A particularly good cooling of the cited critical areas can be hereby achieved.

This applies in a similar manner and furthermore enables the desired cross-section enlargement of the cooling channel in the region of the inflow and outflow if the cited lower level is disposed approximately 3 to 5 mm, in particular 3.5 to 4 mm and particularly preferred approximately 3.8 mm below the cited higher level.

Even though it is not absolutely necessary for the cooling performance, it is preferred in view of the circumstances outlined above for the cross-section of the cooling channel to be enlarged in the region of at least one inflow and/or outflow as compared to the rest of the cooling channel.

As regards the transition from the low level to the higher level and vice versa, a gradual, inclined slope with bends or steps between the, for example, oblique slope and the region at the higher or lower level is provided.

Those areas of the cooling channel that are disposed at the lower level, including the inclined transitions to the higher level, can each take up an angle of approximately 50 to 70°, in particular approximately 60 to 65°.

It is currently preferred for the cross-section design of the cooling channel to be largely oval, with the longer axis of the oval extending largely in the direction of the axis of rotation of the piston, however it may be slightly inclined relative thereto. Currently preferred with regard to this incline is an angle of approximately 7° and/or an incline that is directed outwards at the upper side. Owing to the generally oval design, an efficient cooling of the region "between" the uppermost ring groove and the combustion bowl can be ensured, and the necessary material thicknesses can be maintained at the same time. The incline supports this effect in view of the typical design of a combustion bowl.

Finally, it is currently further preferred for the inflow and outflow to be diametrically opposite one another. Owing hereto as well as to a currently further preferred symmetry relative to the axis of rotation of the piston, the piston may be incorporated at any orientation and any opening may be used as the inflow or outflow.

BRIEF DESCRIPTION OF THE DRAWINGS

An embodiment example that is shown in the figures by way of an example will be explained in more detail in the following.

DETAILED DESCRIPTION OF A PREFERRED EMBODIMENT OF THE INVENTION

Figure 1:
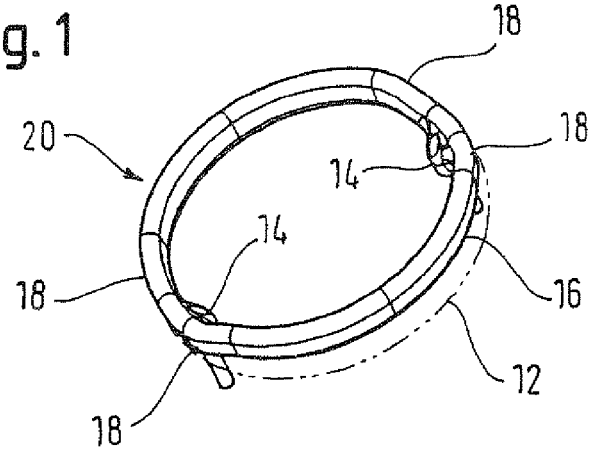
FIG. 1 shows a perspective representation of a salt core that is used in the production of the piston according to the invention.
Figure 2:
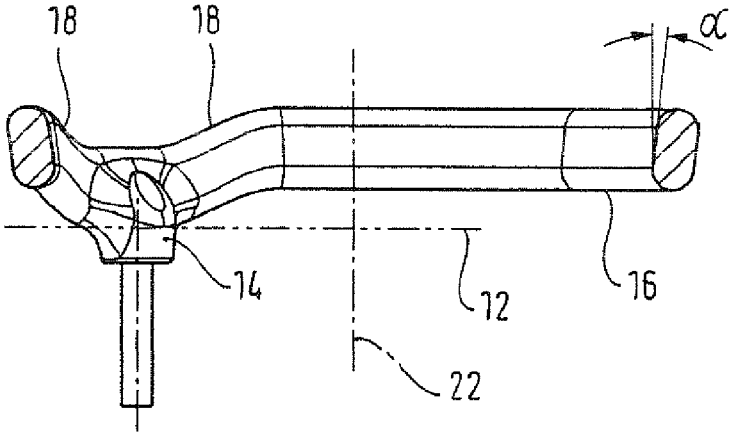
FIG. 2 shows a cutaway side view of a part of the salt core shown in FIG. 1.

Shown in FIG. 1 is first of all a perspective view of the salt core 20 that is used to produce the piston according to the invention. In the shown embodiment, the salt core comprises, as is also the case for the later cooling channel, two diametrically opposite areas that are broader in their cross-section as compared to the rest of the cooling channel and that are later used as inflow and outflow 14. As is already indicated in FIG. 1 by means of the dashed and dotted line, the cooling channel in the region of inflow and outflow 14 is at a lower level than the rest of the cooling channel. In the proximity of inflow and outflow 14 and on both sides of the same, the areas of the cooling channel at the higher level each pass from the higher level 16 to the lower level 12 via inclines 18. It is additionally apparent in FIG. 1 as regards the inflow and outflow 14 that the widening of the cross-section in said embodiment occurs in the direction of the axis of rotation 22 (cf. FIG. 2).

Furthermore, FIG. 2 again shows the two levels 12 and 16 as well as the inclines 18 in the region of the shown inflow or outflow 14. It must in particular be noted that the cross-section of the cooling channel, with the exception of the enlarged area at the inflow and outflow but including the inclines 18, remains largely the same. In the shown embodiment of the cooling channel, the cross-section is largely oval, with the longer axis extending largely parallel or in any case at an acute angle to the axis of rotation 22 of the piston. In the shown embodiment, an angle $\alpha$ of, for example, approximately 7° is formed between the axis of rotation 22 of the piston and the longer axis of the oval which forms the cross-section of the cooling channel.

Figure 3:
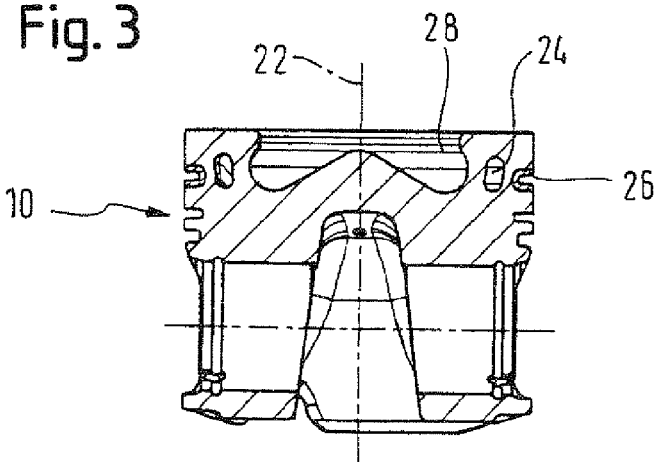
FIG. 3 shows a sectional view of the piston according to the invention.

It is additionally apparent from FIG. 3 how the cooling channel 24 can be disposed in a favourable manner at the level of a ring carrier 26 and the combustion bowl 28 owing to the measure according to the invention. Owing to its oval shape in the direction of the axis of rotation 22 of the piston 10, the cooling channel 24 fits in the region between the ring carrier 26 and the combustion bowl 28 and can cool these critical zones in a particularly efficient manner without compromising the strength owing to too low a material thickness. It is in particular apparent from FIG. 3 that in the shown embodiment, the cooling channel 24 is largely disposed, as regards its lower edge, at the level of the lower edge of the ring carrier 26 and even slightly above the bottom of the combustion bowl 28. As is apparent in combination with FIG. 2, the areas at the inflow and outflow may also be enlarged in the design according to FIG. 3, without compromising the material thickness between the ring carrier 26 and the combustion bowl 28 since the cooling channel 24 is lowered in these regions to the lower level 12.

The invention claimed is:

1. A piston for an internal combustion engine, comprising a plurality of ring grooves including an upper-most ring groove which extends about an axis, at least one annular cooling channel which is circumferentially continuous about the axis and has an inflow area and an outflow area and including a pair of higher main areas that each extend between the inflow and outflow areas, the annular cooling channel including two pairs of inclined transitions, a first pair of the inclined transitions connecting the higher main areas to a single inflow opening in the inflow area, and a second pair of the inclined transitions connecting the higher main areas to a single outflow opening in the outflow area such that no higher main areas are located axially above the inflow and outflow areas, the inflow and outflow areas being disposed at a lower level below that of the upper-most ring groove, and wherein the higher main areas do not deviate axially from a horizontal center plane and wherein at least the majority of the cross section of the higher main areas is disposed at a higher level that is at or above the upper-most ring groove and wherein the annular cooling channel includes inclined slopes that join the lower inflow and outflow areas with the higher main areas, and wherein at least the majority of the cross section of the higher main areas of the cooling channel includes a lower edge substantially at the same level as a lower edge of the upper-most ring groove.

2. The piston according to claim 1 wherein the lower level is disposed about 3 to 5 mm below the higher level.

3. The piston according to claim 1, wherein in at least one of the inflow and outflow areas, the cross-section of the cooling channel is enlarged as compared to the rest of the progression of the cooling channel.

4. The piston according to claim 1, wherein the areas of the cooling channel disposed at the lower level, including the inclined transitions to the higher level, take up an angle of about 50 to 70.

5. The piston according to claim 1, wherein the cooling channel has an oval cross-section with a longer axis that extends substantially in the direction of the axis of rotation of the piston.

6. The piston according to claim 5, wherein the axis of the cooling channel that is longer in cross-section is tilted outwards by about 5 to 10°, relative to the axis of rotation of the piston.

7. The piston according to claim 5, wherein the axis of the cooling channel that is longer in cross-section is tilted outwards by about 7° relative to the axis of rotation of the piston.

8. The piston according to claim 1, wherein the inflow and outflow areas are diametrically opposite one another.

9. The piston according to claim 1, wherein the lower level is disposed about 3.5 to 4 mm below the higher level.

10. The piston according to claim 1, wherein the lower level is disposed about 3.8 mm below the higher level.

11. The piston according to claim 1 wherein the areas of the cooling channel disposed at the lower level, including the inclined transitions to the higher level, take up an angle of about 60 to 65°.

12. The piston according to claim 1, wherein the annular cooling channel is disposed along an annular path and the lower level of the annular cooling channel and the at least one inflow area and the at least one outflow area is disposed on the annular path.

13. The piston of claim 1, wherein the annular cooling channel consists of two channel segments including a first channel segment extending continuously from the inflow area to the outflow area and a second channel segment extending continuously from the outflow area to the inflow area.

14. The piston of claim 13, wherein the openings are diametrically opposite one another, and the openings face parallel to the axis of the piston.

15. The piston of claim 14, wherein the cross-section of the cooling channel is enlarged in the inflow and outflow areas compared to the rest of the cooling channel.

* * * * *